United States Patent [19]

Herglotz

[11] 3,958,744

[45] May 25, 1976

[54] STRUCTURES FOR FORMING DETACHABLE COUPONS AND THE LIKE

[75] Inventor: Harald J. Herglotz, Tuscaloosa, Ala.

[73] Assignee: Gulf States Paper Corporation, Tuscaloosa, Ala.

[22] Filed: Jan. 18, 1974

[21] Appl. No.: 434,393

[52] U.S. Cl. ..... 229/6 R; 229/16 R

[51] Int. Cl.[2] ..... B65D 13/00; B65D 1/00; B65D 5/00; B65D 15/00

[58] Field of Search ..... 229/6 R, 16 R, 16 D, 229/17 G, 37 R; 40/312, 306, 2 R, 2 G, 340; 161/406

[56] References Cited

UNITED STATES PATENTS

| | | | |
|---|---|---|---|
| 1,004,055 | 9/1911 | Martin et al. | 40/306 |
| 2,805,816 | 9/1957 | Morgan | 40/2 R |
| 3,205,603 | 9/1965 | Brumley | 229/16 R |
| 3,690,542 | 9/1972 | Jernstrom | 229/8 |
| 3,770,185 | 11/1973 | Reeves | 229/17 G |

*Primary Examiner*—Leonard D. Christian
*Attorney, Agent, or Firm*—Raphael Semmes

[57] ABSTRACT

Structures for providing a single sheet of material or a box formed from the sheet with a manually detachable coupon-bearing surface area. A cut in the sheet to a depth less than the thickness of the sheet defines at least part of the perimeter of the detachable area. A tab adapted to be manually engaged is cooperable with the cut for enabling the surface area to be stripped as a layer from the sheet, the area prior to stripping from the sheet being substantially integral with the underlying region of the sheet. Various embodiments are disclosed.

34 Claims, 10 Drawing Figures

STRUCTURES FOR FORMING DETACHABLE COUPONS AND THE LIKE

BACKGROUND OF THE INVENTION

This invention relates to structures for providing a sheet of material or a box with a detachable surface area bearing a coupon or the like.

Detachable coupons and the like have found extensive use commercially, particularly in the direct mail industry and in retail sales of packaged goods. In the direct mail industry, for example, it is often desirable to provide sheets of printed matter with information areas which are meant to be detached by the recipients and returned to the sender, the areas typically bearing coupons entitling the recipients to discounts on particular items. In the case of packaged goods, boxes often have detachable information areas, typically bearing proof-of-purchase seals and coupons which may be accumulated for redemption of a premium offer.

The methods used for separating the information areas from the sheets or boxes have heretofore been limited to the cumbersome procedures of tearing the sheet or box along perforations or cutting through the thickness of the sheet or box with scissors or a knife edge. These techniques are subject to several disadvantages. For example, the sheet or box may fail to tear precisely at the perforations, possibly resulting in tearing the information area itself. The use of scissors to remove the information area is awkward and may require that a large area of the box be cut out and trimmed to size. Using a knife or razor blade to remove the information area, although less cumbersome than using scissors, presents the danger of accidental injury. Moreover, all these methods produce an opening in the sheet or box, with the result that the structural integrity of the sheet or box is reduced. More importantly, if the box contains perishables such as food, removal of the area before the box has been emptied may cause spoilage or contamination of the contents. Also, because the detached area has the same thickness as the sheet or box from which it is detached, detached areas of this type are bulky and therefore inconvenient and costly to mail.

Container structures having information areas thereon which may be manually detached without the use of scissors or a knife and which do not produce an opening in the container have been proposed in the prior art. See, for example, U.S. Pat. No. 2,142,470 to Claff and U.S. Pat. No. 3,110,121 to Corrinet. These container structures typically comprise a paper sheet and a boxboard sheet laminated together by an adhesive, the paper sheet having lines of weakness therein defining a detachable area of the sheet. The adhesive is made ineffective as to the defined area for preventing the area from adhering to the underlying boxboard sheet, thereby enabling the defined area of the paper layer to be detached from the container by tearing that layer along the lines of weakness.

As compared with boxes manufactured from a single sheet of material such as paperboard, as is presently a standard commercial practice, the multi-layer structures of the prior art are commercially disadvantageous because of the cost and inconvenience of providing and laminating two layers of material and because special apparatus is necessary for laminating the layers by means of an adhesive without permitting the detachable area to adhere to the underlying layer.

BRIEF DESCRIPTION OF THE INVENTION

Accordingly, it is a principal object of the invention to provide a single sheet of material having a detachable surface area which may be easily removed from the sheet or from a box constructed of the sheet of material without the aid of scissors or another cutting instrument.

It is a further object of the invention to provide a single sheet of material having a surface area which can be manually detached therefrom without creating an opening in the sheet or a box constructed from the sheet and without appreciably reducing the structural integrity of the sheet or box.

Briefly stated, in accordance with the invention a manually detachable surface area of a sheet has its perimeter defined at least in part by a cut in the sheet to a depth less than the thickness of the sheet. Means such as a tab adapted to be manually engaged is cooperable with the cut for enabling the surface area to be stripped as a layer from the sheet, the area prior to stripping being substantially integral with the underlying region of the sheet. In a first embodiment the tab is within the surface area and is adapted to be projected from the sheet for manual engagement. In a second embodiment, the tab comprises an edge portion of the sheet adjacent the surface area.

BRIEF DESCRIPTION OF THE DRAWINGS

The invention will be further described with reference to the accompanying drawings, which illustrate preferred and exemplary embodiments, and wherein.

DETAILED DESCRIPTION OF THE INVENTION

Figure 1:
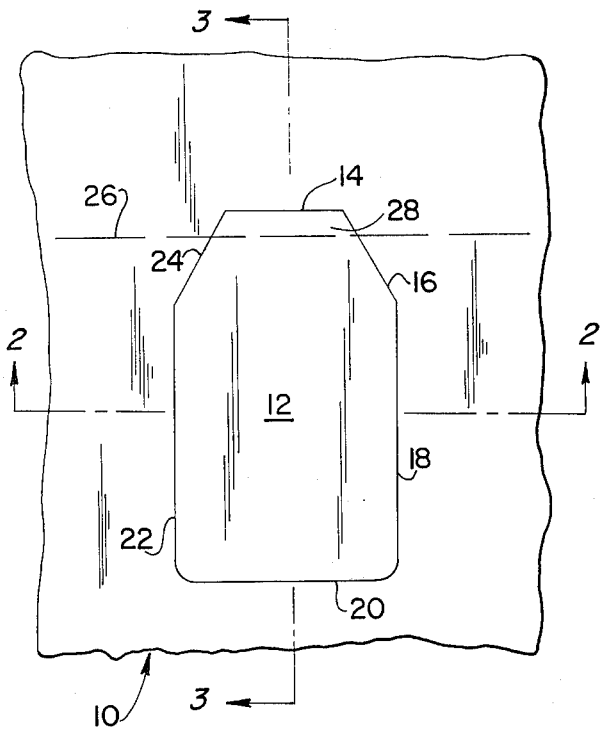
FIG. 1 is a plan view of part of a sheet of material having a structure in accordance with the invention for providing the sheet with a manually detachable surface area.
Figure 2:
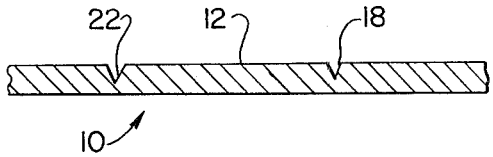
FIG. 2 is a cross-sectional view taken along line 2—2 of FIG. 1.
Figure 3:
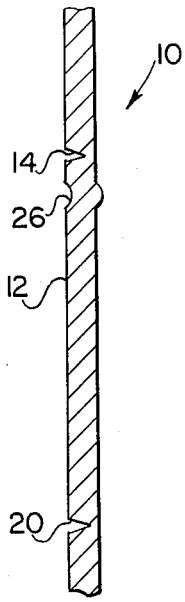
FIG. 3 is a cross-sectional view taken along line 3—3 of FIG. 1.

Referring to the drawings, FIGS. 1–5 illustrate a first structure in accordance with the invention for providing a sheet of material 10 with a manually detachable surface area 12. The perimeter of the detachable area is defined by a series of linear cuts 14, 16, 18, 20, 22 and 24 in sheet 10 to a depth less than the thickness of the sheet. In the preferred form, the sheet of material is paperboard, which is particularly well suited for use with the structures of the invention because the normal manufacture of paperboard creates a sheet having front and back surfaces of greater tensile strength than the intermediate region joining those surfaces. This characteristic of paperboard is more pronounced in a cylinder sheet than in a Fourdrinier sheet. It will be apparent that other materials having this characteristic may also be employed. With such materials it has been discovered that it is only necessary that an edge of the area 12 be manually engaged and pulled from the sheet to cause the entire area 12 to be stripped as a layer from the underlying region of the sheet, the area prior to stripping being substantially integral with the underlying region of the sheet.

Figure 4:
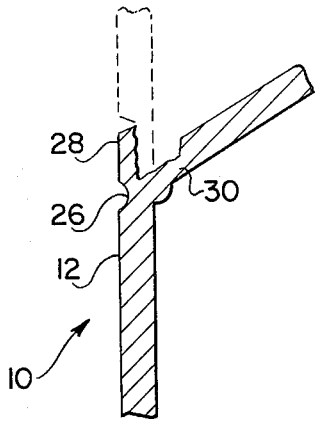
FIG. 4 is a view similar to FIG. 3 but illustrating the sheet of material folded about a line of weakness to expose an edge of the detachable surface area.
Figure 5:
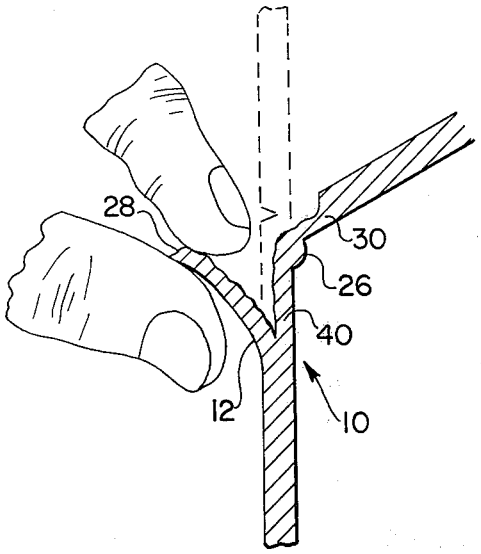
FIG. 5 is a view similar to FIG. 4 but showing the surface area being manually stripped as a layer from the sheet of material.
Figure 6:
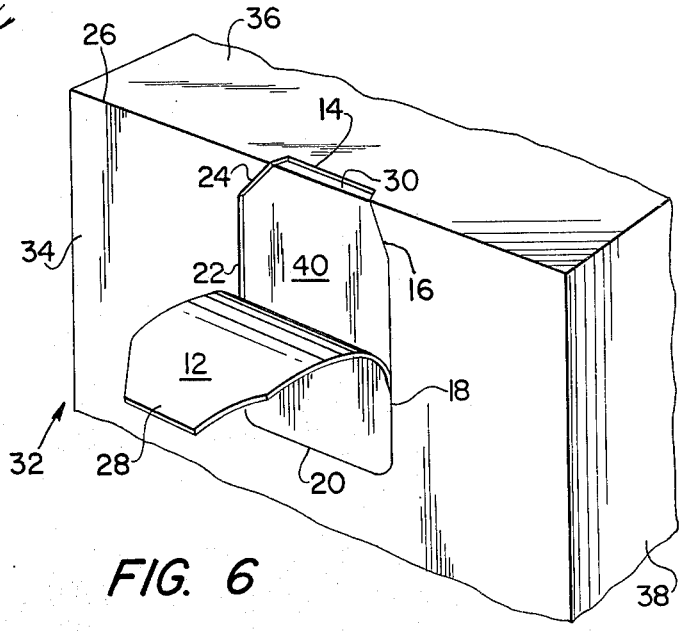
FIG. 6 is a perspective view showing the detachable surface area partially detached from a box formed from the sheet of material illustrated in FIG. 1.

In the embodiment of FIGS. 1–5 the sheet is provided with a line of weakness in the form of a fold line 26 traversing the detachable area and about which the sheet is adapted to be folded. Folding the sheet about the fold line causes the portion of area 12 defined by the fold line and by cuts 14, 16 and 24 to be preliminarily stripped from the sheet as a layer and projected from the sheet to form a tab 28 and an underlying portion 30, as shown in FIG. 4. The tab thus formed may be manually engaged for stripping the remainder of surface area 12 as a layer from the sheet, as shown in FIG. 5, leaving an underlying layer 40. As shown in FIG. 6, the sheet may be formed into a box or carton 32, having sides 34, 36, 38 and other sides not shown, tab 28 being projected when the box blank is folded along line 26. Because removal of the detachable area does not produce an opening in the sheet or in the box formed from such a sheet, the structural integrity of the sheet or box is maintained. Furthermore, because the detachable area after detachment is formed of a layer of material having a substantially uniform thickness less than that of the sheet from which it has been detached, detached areas having coupons thereon (accumulated, for example, for redemption of a premium offer) are less bulky and therefore more conveniently and less expensively mailed than thicker detachable coupons of the type heretofore in commercial use.

Figure 7:
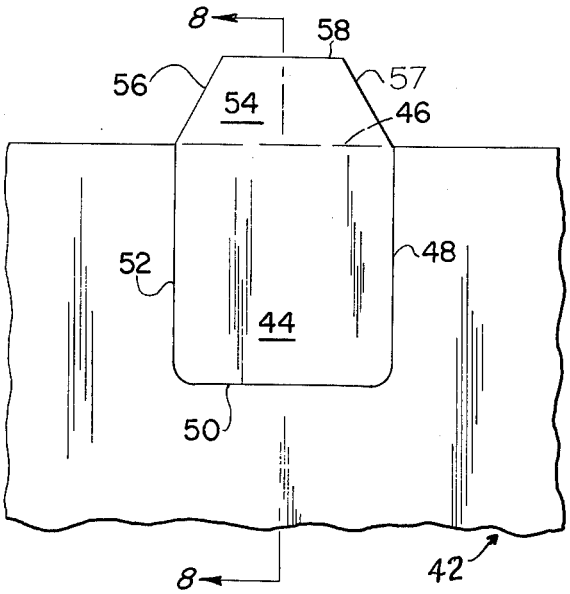
FIG. 7 is a fragmentary plan view of a sheet of material provided with another structure in accordance with the invention.
Figure 8:
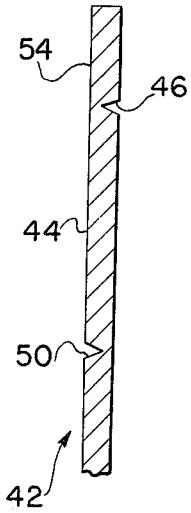
FIG. 8 is a cross-sectional view taken along line 8—8 of FIG. 7.
Figure 9:
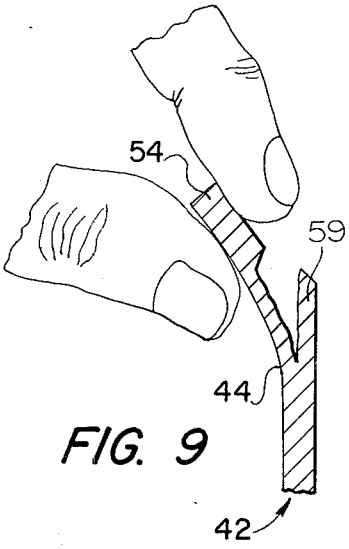
FIG. 9 is a view similar to FIG. 8 but showing a tab being manually grasped for stripping the detachable surface area from the sheet.

FIGS. 7–9 illustrate a sheet of material 42 having a second type of structure in accordance with the invention for providing the sheet with a detachable area 44. The area is defined by a cut 46 on one side of the sheet to a depth less than the thickness of the sheet and by cuts 48, 50 and 52 on the opposite side of the sheet and to a depth less than the thickness of the sheet. Edges 56, 57 and 58 of the sheet are cooperable with cut 46 for defining an edge portion or tab 54 which may be manually grasped for stripping area 44 as a layer from sheet 42 as shown in FIG. 9, leaving an underlying layer 59.

Figure 10:
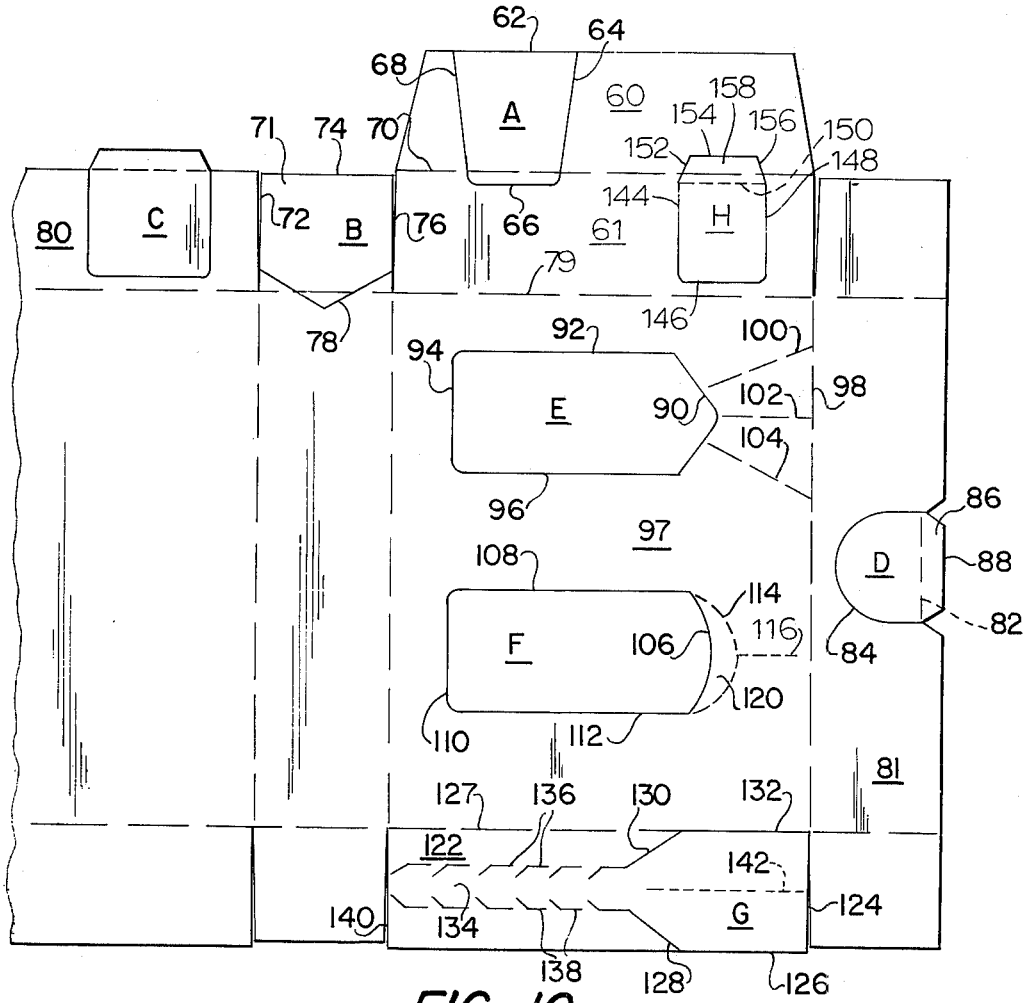
FIG. 10 is a plan view of part of a box blank having various structures in accordance with the invention for forming detachable surface areas.

Referring to FIG. 10, for simplicity of illustration various structures in accordance with the invention for providing a sheet or a box with detachable areas A through H are shown on a single box blank sheet having characteristics of blanks for both tuck-end and seal-end boxes. Of course, it will be understood that usually no more than one or two of the illustrated structures will be formed on a single sheet or box.

Detachable areas A and B are structures somewhat similar to the structure of detachable area 12 of FIGS. 1–5. Area A is formed on a tuck-end flap comprising a tuck portion 60 and an end portion 61, the area being defined by edge 62 of the flap and by cuts 64, 66 and 68 to a depth less than the thickness of the sheet. Folding the flap about score line 70 causes an edge portion of the area adjacent cut 66 to be preliminarily delaminated from the underlying material of the sheet and projected from the sheet as a tab adapted for manual engagement. When the box is closed, the detachable area is hidden from view, only the tab portion being exposed, making the detachable area pilfer-proof.

Area B is formed on a flap 71 of either a seal-end or a tuck-end box, this flap being closed first or second during the normal closing sequence. The area is defined by edges 72, 74 and 76 of the flap and by cut 78, the cut being to a depth less than the thickness of the sheet. The cut cooperates with a score line 79 of the sheet for projecting a portion of the area adjacent cut 78 as a tab when the flap is in closed position. This configuration is likewise pilfer-proof because the box must be opened to expose the flap. However, the size of the detachable area is limited by the small surface area of the flap.

Detachable area C, shown on a sealing flap 80 which in the sequence of closing a seal-end box is closed last, is identical to the detachable area 44 illustrated in FIGS. 7–9 and therefore will not be described in detail. However, it will be noted that the detachable area may be formed on the tuck portion 60 of a tuck-end box, the area thus formed being hidden from view when the box is closed.

Detachable area D is defined by a first cut 82 on the underside of sealing side flap 81 to a depth less than the thickness of the sheet and by second cut 84 on the other side of the flap to a depth less than the thickness of the sheet. Edge 88 of the sheet is cooperable with cut 82 for defining a tab portion 86 adapted to be manually engaged. A box may be constructed from the blank by overlapping side flap 81 of the blank with another side flap (not shown) and gluing the two side flaps together, forming a side comprising two thicknesses of the sheet. As a result, detachment of the area D from the side of the box does not appreciably reduce the structural integrity of the box. The structure forming area D, applied at the glue seam, may be utilized on any box or carton having a seam or glued area of this type.

Detachable areas E and F include tab portions which are projected from the sheet by manually depressing regions of the sheet adjacent the tab portions. Area E is defined by cuts 90, 92, 94 and 96 on the side portion 97 of the box blank, the cuts being to a depth less than the thickness of the sheet. Extending along directions intersecting fold line 98 and the tab portion of area E are lines of weakness in the form of score lines 100, 102 and 104. Manually depressing the box formed from the blank at the corner edge of the box near the junction of lines 98 and 102 until the box buckles at this point moves the part of the box side between lines 100 and 104 downwardly with respect to area E, causing the edge portion of area E adjacent cut 90 to be preliminarily delaminated from the underlying region of the sheet and projected as a tab which may be manually engaged to strip area E as a layer from the side of the box. Because the detached area is formed of a layer of material of less thickness than the box blank, removal of the detachable area from the box does not produce an opening therein. Therefore, if the box contains food, the area may be detached before the box is opened without subjecting the food to spoilage by exposure or to contamination by insects.

A series of cuts 106, 108, 110 and 112 to a depth less than the thickness of the sheet defines the perimeter of detachable area F. Lines of cuts or perforations 114 and 116 substantially through the sheet are provided in close proximity to the detachable area, the opposite ends of curvilinear line of cuts or perforations 114 meeting or approaching respective opposite ends of cut 106 for defining a substantially crescent-shaped section 120 of the sheet adjacent the detachable area. Manually depressing the side of the box formed from the blank in the region of the cuts or perforations breaks the box side along the cuts or preforations and moves section 120 of the package downwardly with respect to the detachable area, causing the portion of area F adjacent cut 106 to be separated as a layer from the underlying material of the box side and to be projected as a tab which may be manually engaged for detaching area F.

Detachable area G is defined by edges 124 and 126 of sealing-end flap 122 and by cuts 128, 130 and 132 in the flap to a depth less than the thickness of the sheet. Cut 132 may, as shown in FIG. 10, coincide with a fold line 127 of the blank. A zipper strip 134 integral with area G is provided by two rows of perforations 136 and 138 through the flap extending from end 140 of the flap to cuts 128 and 130. After the zipper strip has been pulled to completely separate it from the end flap along the perforations, further pulling causes the area G to be stripped as a layer from the underlying material of the end flap by virtue of diverging cuts 128 and 130. The end flap may be provided with an additional cut 142 on the underside of the flap beneath the detachable area to a depth less than the thickness of the sheet. With this structure, removal of the zipper strip 134 and the area G from the flap causes the underlying portion of the flap to be divided into two parts by cut 142, thereby completely severing the flap. The integral detachable area and zipper strip of the invention can be formed on a box in almost any area where a zipper strip is normally found. Furthermore, the detachable area may be located intermediate the ends of the zipper strip instead of forming one of the ends of the zipper strip.

Detachable area H, defined by cuts 144, 146 and 148 in one side of end portion 61 of the tuck-end flap to a depth less than the thickness of the sheet and by a cut 150 parallel to score line 70 in the other side of the flap to a depth less than the thickness of the sheet, is similar in structure to detachable areas C and D but with cut 150 being cooperable with cuts 152, 154 and 156 which extend substantially through the thickness of the sheet for forming a tab portion 158. Folding the tuck-end flap about score line 70 causes the tab portion to be projected from the flap, thereby enabling the tab portion to be manually engaged for stripping the detachable area as a layer from end portion 61 of the flap. The opening produced in tuck portion 60 of the tuck-end flap by projection of tab portion 158 is hidden from view when the tuck portion is inserted in the carton.

While various embodiments of the invention have been shown and described, it will be apparent to those skilled in the art that changes can be made in these embodiments without departing from the principles and spirit of the invention, the scope of which is defined in the appended claims.

The invention claimed is:

1. A structure for providing a sheet of material with a coupon or the like constituted by a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said layer having a substantially uniform thickness less than the thickness of said sheet throughout said area, said area prior to stripping from said sheet being substantially integral with the underlying region of said sheet.

2. A structure as set forth in claim 1, wherein said means cooperable with said cut comprises a tab adapted to be manually engaged.

3. A structure as set forth in claim 2, wherein said tab is within said surface area.

4. A structure as set forth in claim 3, wherein said sheet has means for projecting said tab therefrom for manual engagement.

5. A structure for providing a sheet of material with a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said area prior to stripping from said sheet being substantially integral with the underlying region of said sheet, said means cooperable with said cut comprising a tab within said surface area adapted to be manually engaged, said sheet having means for projecting said tab therefrom for manual engagement, the last-mentioned means comprising a line of weakness in said sheet traversing said area and about which said sheet is adapted to be folded, whereby a portion of said area is preliminarily stripped from said sheet as a layer when the sheet is folded.

6. A structure for providing a sheet of material with a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said area prior to stripping from said sheet being substantially integral with the underlying region of said sheet, said means cooperable with said cut comprising a tab within said surface area adapted to be manually engaged, said sheet having means for projecting said tab therefrom for manual engagement, the last-mentioned means comprising lines of weakness in said sheet forming a manually depressible region of said sheet adjacent to said tab, whereby said tab is projected when said depressible region is depressed.

7. A structure as set forth in claim 6, wherein said lines of weakness are score lines along directions intersecting said tab.

8. A structure as set forth in claim 6, wherein said lines of weakness are perforations through said sheet.

9. A structure as set forth in claim 2, wherein said tab is defined by an edge portion of said sheet.

10. A structure for providing a sheet of material with a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said area prior to stripping from said sheet being substantially integral with the underlying region of said sheet, said means cooperable with said cut comprising a tab adapted to be manually engaged, said tab being defined by an edge portion of said sheet, said tab being further defined by a second cut in said sheet to a depth less than the thickness of the sheet and at the side of said sheet opposite the side of the first-mentioned cut.

11. A structure as set forth in claim 1, wherein said means cooperable with said cut comprises an edge portion of said sheet.

12. A structure as set forth in claim 1, wherein said sheet of material is paperboard or the like having greater tensile strength at its opposite surfaces than at an intermediate region.

13. A structure as set forth in claim 2, wherein said tab is defined by a cut substantially through the thickness of said sheet.

14. A structure for providing a sheet of material with a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said area prior to stripping from said sheet being substantially integral with the underlying region of said sheet, said means cooperable with said cut comprising a tab adapted to be manually engaged, said tab being defined by a cut substantially through the thickness of said sheet, said tab being further defined by a second cut in said sheet to a depth less than the thickness of the sheet and at the side of said sheet opposite the side of the first-mentioned cut.

15. A structure for providing a sheet of material with a manually detachable surface area within a predetermined perimeter, the structure comprising means including a cut in said sheet to a depth less than the thickness of the sheet for defining at least part of the perimeter of said detachable area, and means cooperable with said cut for enabling said area to be stripped as a layer from said sheet and separated from said sheet without forming a hole through said sheet, said area prior to stripping from said sheet being substantially integral with the underlying region of said sheet, said means cooperable with said cut comprising a tab adapted to be manually engaged, said tab being defined by a cut substantially through the thickness of said sheet, said sheet having means comprising a line of weakness about which said sheet is adapted to be folded for projecting said tab from said sheet for manual engagement.

16. A box comprising wall means having a structure for providing a coupon or the like constituted by a manually detachable surface area within a predetermined perimeter, said structure comprising means including a cut in said wall means to a depth less than the thickness of the wall means for defining at least part of the perimeter of said detachable area, and means cooperable with the cut for enabling said area to be stripped as a layer from said wall means and separated from said box without forming a hole in said box, said layer having a substantially uniform thickness less than the thickness of said sheet throughout said area, said area prior to stripping from said wall means being substantially integral with the underlying region of said wall means.

17. A box as set forth in claim 16, wherein said means cooperable with said cut comprises a tab adapted to be manually engaged.

18. A box as set forth in claim 17, wherein said tab is within said surface area.

19. A box comprising wall means having a structure for providing a manually detachable surface area within a predetermined perimeter, said structure comprising means including a cut in said wall means to a depth less than the thickness of the wall means for defining at least part of the perimeter of said detachable area, and means cooperable with the cut for enabling said area to be stripped as a layer from said wall means and separated from said box without forming a hole in said box, said area prior to stripping from said wall means being substantially integral with the underlying region of said wall means, said means cooperable with said cut comprising a tab within said surface area adapted to be manually engaged, said wall means comprising means for projecting said tab therefrom for manual engagement.

20. A box as set forth in claim 19, wherein the last-mentioned means comprises a line of weakness in said wall means traversing said area and about which said wall means is adapted to be folded, whereby a portion of said area is preliminarily stripped from said wall means as a layer when the wall means is folded.

21. A box as set forth in claim 19, the last-mentioned means comprising lines of weakness in said wall means forming a manually depressable region of said wall means adjacent to said tab, whereby said tab is projected when said depressable region is depressed.

22. A box as set forth in claim 21, wherein said lines of weakness are score lines along directions intersecting said tab.

23. A box as set forth in claim 21, wherein said lines of weakness are perforations through said wall means.

24. A box as set forth in claim 17, wherein said tab is defined by an edge portion of said wall means.

25. A box as set forth in claim 16, wherein said means cooperable with said cut comprises an edge portion of said wall means.

26. A box as set forth in claim 16, wherein said wall means is paperboard or the like having greater tensile strength at its opposite surfaces than at an intermediate region.

27. A box as set forth in claim 17, wherein said tab is defined by a cut substantially through the thickness of said wall means.

28. A box as set forth in claim 27, wherein said tab is further defined by a second cut in said wall means to a depth less than the thickness of the wall means and at the side of the wall means opposite the side of the first-mentioned cut.

29. A box as set forth in claim 27, wherein said wall means has means comprising a line of weakness about which said wall means is adapted to be folded for projecting said tab from said wall means for manual engagement.

30. A box comprising wall means having a structure for providing a manually detachable surface area within a predetermined perimeter, said structure comprising means including a cut in said wall means to a depth less than the thickness of the wall means for defining at least part of the perimeter of said detachable area, and means cooperable with the cut for enabling said area to be stripped as a layer from said wall means and separated from said box without forming a hole in said box, said area prior to stripping from said wall means being substantially integral with the underlying region of said wall means, said means cooperable with said cut comprising a tab adapted to be manually engaged, said tab being defined by an edge portion of said wall means, said tab being further defined by a second cut in said wall means to a depth less than the thickness of the wall means and at the side of said wall means opposite the side of the first-mentioned cut.

31. A box comprising a uniform-thickness wall panel having a structure for providing a manually detachable zipper strip integral with a manually detachable surface area within a predetermined perimeter, said structure comprising means including a cut in said wall panel to a depth less than the thickness of the wall panel for defining at least part of the perimeter of said detachable area, and means cooperable with the cut for enabling said area to be stripped as a layer from said wall panel and separated from said wall panel concurrently with the separation of said zipper strip from said wall panel, said area prior to stripping from said wall panel being substantially integral with the underlying region of said wall panel.

32. A box as set forth in claim 31, wherein said area and said zipper strip are formed on a flap of said box and wherein said cut is formed on one side of said flap and a further cut is formed on the opposite side of said flap beneath said area to a depth less than the thickness of the flap, whereby said flap may be completely severed when said zipper strip and said area are removed.

33. A box blank comprising a uniform-thickness wall panel having a structure for providing a manually detachable zipper strip integral with a manually detachable surface area within a predetermined perimeter, said structure comprising means including a cut in said wall panel to a depth less than the thickness of the wall panel for defining at least part of the perimeter of said detachable area, and means cooperable with the cut for enabling said area to be stripped as a layer from said wall panel and separated from said wall panel concurrently with the separation of said zipper strip from said wall panel, said area prior to stripping from said wall panel being substantially integral with the underlying region of said wall panel.

34. A structure for providing a sheet of material with a manually detachable surface area, the structure comprising means including a cut in said sheet to a depth less than the thickness of the sheet for defining at least part of the perimeter of said detachable area, and means including a manually engageable tab cooperable with said cut for enabling said area to be stripped as a layer from said sheet, said area prior to stripping from said sheet being substantially integral with the underlying region of said sheet, said tab being defined by an edge portion of said sheet and being further defined by a second cut in said sheet to a depth less than the thickness of the sheet and at the side of said sheet opposite the side of the first-mentioned cut.

* * * * *